US011517995B2

(12) United States Patent
Cui et al.

(10) Patent No.: US 11,517,995 B2
(45) Date of Patent: Dec. 6, 2022

(54) WET CHEMICAL HEATING SYSTEM AND A METHOD OF CHEMICAL MECHANICAL POLISHING

(71) Applicant: TAIWAN SEMICONDUCTOR MANUFACTURING COMPANY LTD., Hsinchu (TW)

(72) Inventors: Ji James Cui, Hsinchu (TW); Chia-Hsun Chang, Changhua County (TW); Chih Hung Chen, Hsinchu (TW); Liang-Guang Chen, Hsinchu (TW); Tzu Kai Lin, Tainan (TW); Chyi Shyuan Chern, Taipei (TW); Keith Kuang-Kuo Koai, Hsinchu County (TW)

(73) Assignee: TAIWAN SEMICONDUCTOR MANUFACTURING COMPANY LTD., Hsinchu (TW)

( * ) Notice: Subject to any disclaimer, the term of this patent is extended or adjusted under 35 U.S.C. 154(b) by 713 days.

(21) Appl. No.: 16/448,963

(22) Filed: Jun. 21, 2019

(65) Prior Publication Data

US 2020/0070301 A1 Mar. 5, 2020

Related U.S. Application Data

(60) Provisional application No. 62/724,854, filed on Aug. 30, 2018.

(51) Int. Cl.

| | |
|---|---|
| ***B24B 49/00*** | (2012.01) |
| ***B24B 37/015*** | (2012.01) |
| ***B24B 57/02*** | (2006.01) |
| ***B24B 37/34*** | (2012.01) |

(52) U.S. Cl.
CPC ..... *B24B 37/015* (2013.01); *B24B 37/34* (2013.01); *B24B 57/02* (2013.01)

(58) Field of Classification Search
CPC ..... B24B 37/015; B24B 37/34; B24B 57/02
USPC ..... 451/7, 5, 41, 53, 317, 287
See application file for complete search history.

(56) References Cited

U.S. PATENT DOCUMENTS

| | | | | |
|---|---|---|---|---|
| 6,315,635 | B1 * | 11/2001 | Lin | B24B 57/02 451/7 |
| 2005/0003737 | A1 * | 1/2005 | Montierth | H01L 21/67057 451/5 |
| 2010/0035515 | A1 * | 2/2010 | Marks | B24B 37/015 451/317 |
| 2014/0004626 | A1 * | 1/2014 | Xu | B24B 37/015 257/E21.528 |

(Continued)

FOREIGN PATENT DOCUMENTS

WO WO2017218921 A1 12/2017

OTHER PUBLICATIONS

Heating Element, https://en.wikipedia.org/wiki/Heating_element.

*Primary Examiner* — Joseph J Hail
*Assistant Examiner* — Shantese L McDonald
(74) *Attorney, Agent, or Firm* — WPAT Law; Anthony King

(57) ABSTRACT

The present disclosure provides a wet chemical heating system, including a first conduit for transporting wet chemical, a dispensing head connected to the first conduit, and a radiative heating element configured to heat the wet chemical in the first conduit and positioned at an upper stream of the dispensing head.

20 Claims, 7 Drawing Sheets

(56) References Cited

U.S. PATENT DOCUMENTS

2017/0232572 A1* 8/2017 Brown ..... B24B 37/107
451/5
2017/0361419 A1* 12/2017 Elkhatib ..... B24B 37/20

* cited by examiner

WET CHEMICAL HEATING SYSTEM AND A METHOD OF CHEMICAL MECHANICAL POLISHING

CROSS REFERENCE TO RELATED APPLICATIONS

This application claims the benefit of prior-filed provisional application No. 62/724,854, filed Aug. 30, 2018, which is incorporated by reference in its entirety.

BACKGROUND

Chemical mechanical planarization (CMP) is a skill for smoothing a non-uniform surface during fabrication operation. Wet chemicals such as CMP slurry, cleaning agent, deionized water (DI water), or the like, can be utilized during the CMP operation to remove excessive particles generated thereof.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
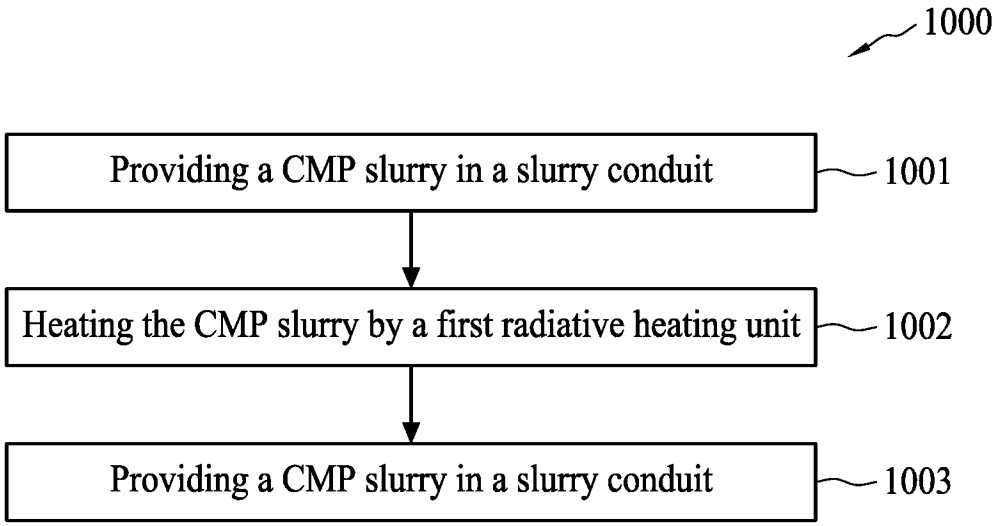
FIG. 1 shows a flow chart representing method of chemical mechanical planarization (CMP), in accordance with some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in the respective testing measurements. Also, as used herein, the terms "substantially," "approximately," or "about" generally means within a value or range which can be contemplated by people having ordinary skill in the art. Alternatively, the terms "substantially," "approximately," or "about" means within an acceptable standard error of the mean when considered by one of ordinary skill in the art. People having ordinary skill in the art can understand that the acceptable standard error may vary according to different technologies. Other than in the operating/working examples, or unless otherwise expressly specified, all of the numerical ranges, amounts, values and percentages such as those for quantities of materials, durations of times, temperatures, operating conditions, ratios of amounts, and the likes thereof disclosed herein should be understood as modified in all instances by the terms "substantially," "approximately," or "about." Accordingly, unless indicated to the contrary, the numerical parameters set forth in the present disclosure and attached claims are approximations that can vary as desired. At the very least, each numerical parameter should at least be construed in light of the number of reported significant digits and by applying ordinary rounding techniques. Ranges can be expressed herein as from one endpoint to another endpoint or between two endpoints. All ranges disclosed herein are inclusive of the endpoints, unless specified otherwise.

In order to ameliorate the performance of the chemical mechanical planarization operation (CMP), wet chemicals entailed in CMP operation, such as CMP slurry, deionized water, cleaning agent, can be heated so that the polishing rate can be increased as the efficiency of the CMP operation can be improved. Thereby a throughput rate of CMP operation is positively correlated to a temperature of CMP slurry.

Conventionally, a heating element is directly mounted on a conduit for transporting aforesaid wet chemicals to elevate temperature thereof. However, under the consideration of a limited space of an apparatus and cost reduction, a material of conduits may be bendable, which includes plastic or polymer (e.g. fluoropolymers, polytetrafluoroethylene, polyvinylidene fluoride, etc.), thereby the heating element directly contacting conduit for delivering wet chemicals may induce reliability issues thereto, such as deformation, oxidation, peeling, or generating defects, thence further deteriorating the yield rate of fabricated semiconductor structure.

The present disclosure provides a wet chemical heating system including heating devices for heating CMP slurry, and methods of chemical mechanical planarization to alleviate the risk of inducing aforesaid issue while improving the performance of the CMP operation.

Referring to FIG. 1, FIG. 1 shows a flow chart representing method 1000 of chemical mechanical planarization, in accordance with some embodiments of the present disclosure. The method 1000 of CMP includes providing a CMP slurry in a slurry conduit (operation 1001), heating the heating the CMP slurry by a first radiative heating unit (operation 1002), and dispensing the CMP slurry on a CMP platen (operation 1003).

Figure 2:
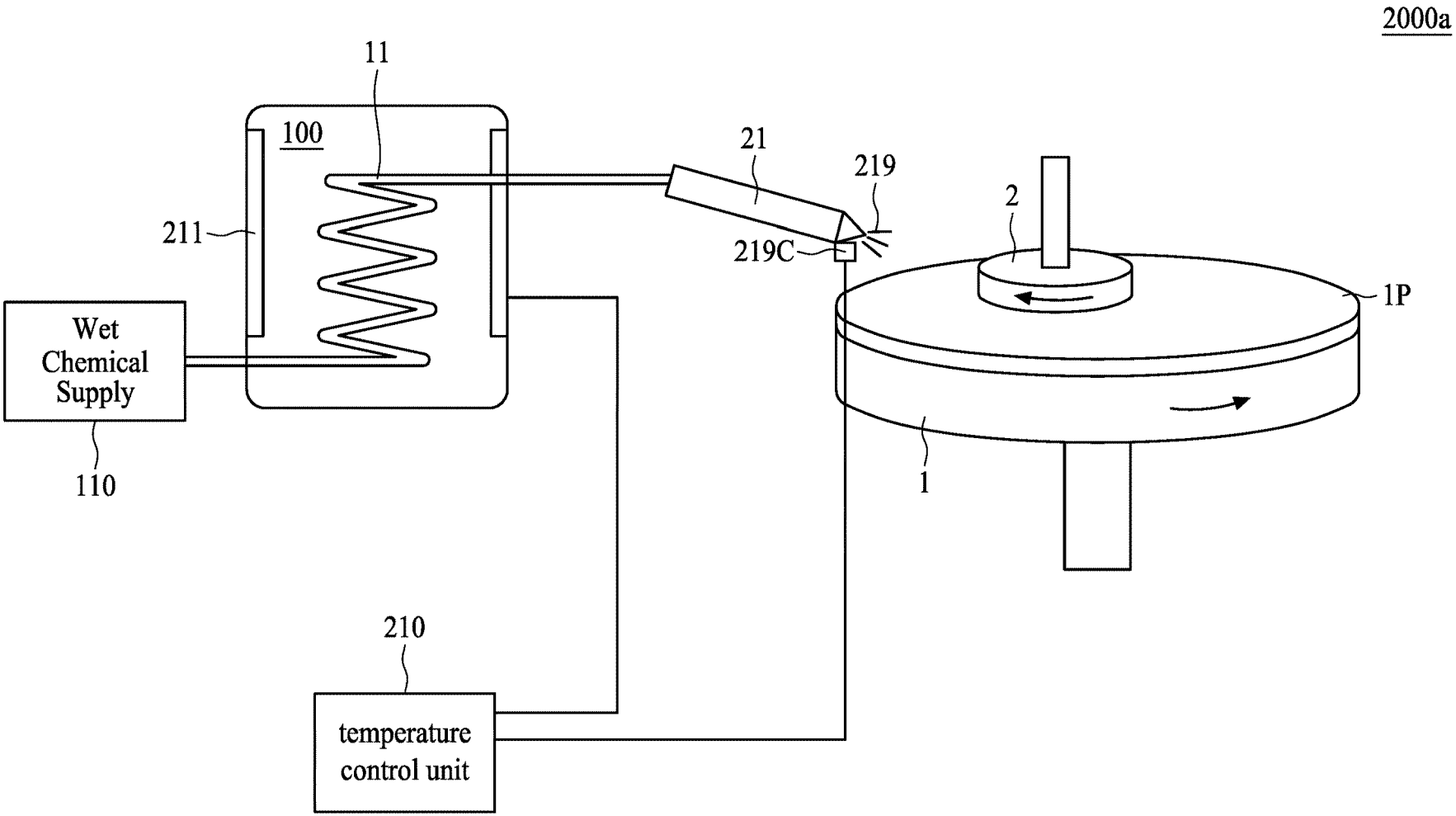
FIG. 2 is a schematic view showing a wet chemical heating system, in accordance with some embodiments of the present disclosure.

Referring to FIG. 2, FIG. 2 is a schematic view showing a wet chemical heating system 2000*a*, in accordance with some embodiments of the present disclosure. The wet chemical heating system 2000*a* includes a CMP platen 1, a first conduit 11 for transporting wet chemical 219, a first dispensing head 21 connected to the first conduit 11 and a first radiative heating element 211 configured to heat the wet chemical 219 in the first conduit 11. Specifically, the first radiative heating element 211 is positioned at an upstream of the first dispensing head 21 and is configured to elevate a temperature of the wet chemical 219 in the first conduit 11 prior to dispensing. The wet chemical heating system 2000*a* may further include a polishing head 2 configured to secure a substrate (such as a wafer), rotate the substrate, and apply a force on the substrate against the CMP platen 1. In some embodiments, the CMP platen 1 includes a pad 1P disposed at a top surface of the CMP platen 1, as the pad 1P can ameliorate the performance of CMP operation by virtue of polishing effect. In some embodiments, the CMP platen 1 and the pad 1P are rotated in opposite directions. A wet chemical supply 110 may include a storage space for accommodating wet chemical 219 and a pump for supplying wet chemical 219. In some embodiments, the wet chemical 219 includes CMP slurry.

CMP slurry is composed of abrasive and corrosive wet chemical to planarization features on a substrate. The wet chemical 219 supplied by the wet chemical supply 110 is transported through the first conduit 11 to the first dispensing head 21, as the first dispensing head 21 can apply the wet chemical 219 on the CMP platen 1. In some embodiments, due to the configuration of the wet chemical heating system 2000*a*, the first conduit 11 may meander within a limited space or loop around obstructions; therefore a material of the first conduit 11 may have adequate bendability or flexibility while avoiding significant cost. The material of the first conduit 11 may include plastic or polymer, for example fluoropolymers (e.g. polytetrafluoroethylene, polyvinylidene fluoride), or the like. The first conduit 11 has an adequate cross sectional area in order to meet the supply pressure of the wet chemical supply 110, so that a flow rate of the wet chemical 219 may be controlled in a range from about 10 mL/min to about 2,000 mL/min. A flow rate below 10 mL/min may induce significant inefficiency of CMP operation, and a flow rate above 2,000 mL/min may require significantly greater radius of the first conduit 11 or significantly high supply pressure from the wet chemical supply 110, such configurations increases the difficulty of elevating a temperature of the wet chemical 219 in the first conduit 11.

In some embodiments, in order to enhance the efficiency of CMP operation, the wet chemical 219 can be CMP slurry with elevated temperature (e.g., temperature greater than room or ambient temperature), that is, the CMP slurry is heated in the first conduit 11 prior to dispensing. A first radiative heating unit 100 is configured to heat the wet chemical 219 in the first conduit 11, wherein the first radiative heating unit 100 is positioned at an upper stream of the first dispensing head 21, so that the wet chemical 219 is preconditioned before being dispensed on the CMP platen 1. In some embodiments, a temperature of the wet chemical 219 is elevated to at least 1° C. above an ambient temperature, and the efficiency of CMP operation may be significantly improved compared to the situation using wet chemical 1° C. cooler. In some embodiments, the wet chemical 219 can be heated up to 95° C. before material property (e.g. colloidal stability) of the wet chemical 219 being significantly altered.

Since the first conduit 11 for transporting the wet chemical 219 may include plastic or polymer, heating by direct contact may induce reliability issues of the first conduit 11, such as deformation, oxidation, peeling, or generating defects. Therefore the wet chemical 219 in present disclosure is heated by a first radiative heating element 211 of the first radiative heating unit 100 to avoid direct contact of the heating element 211 and the first conduit 11.

Figure 3A:
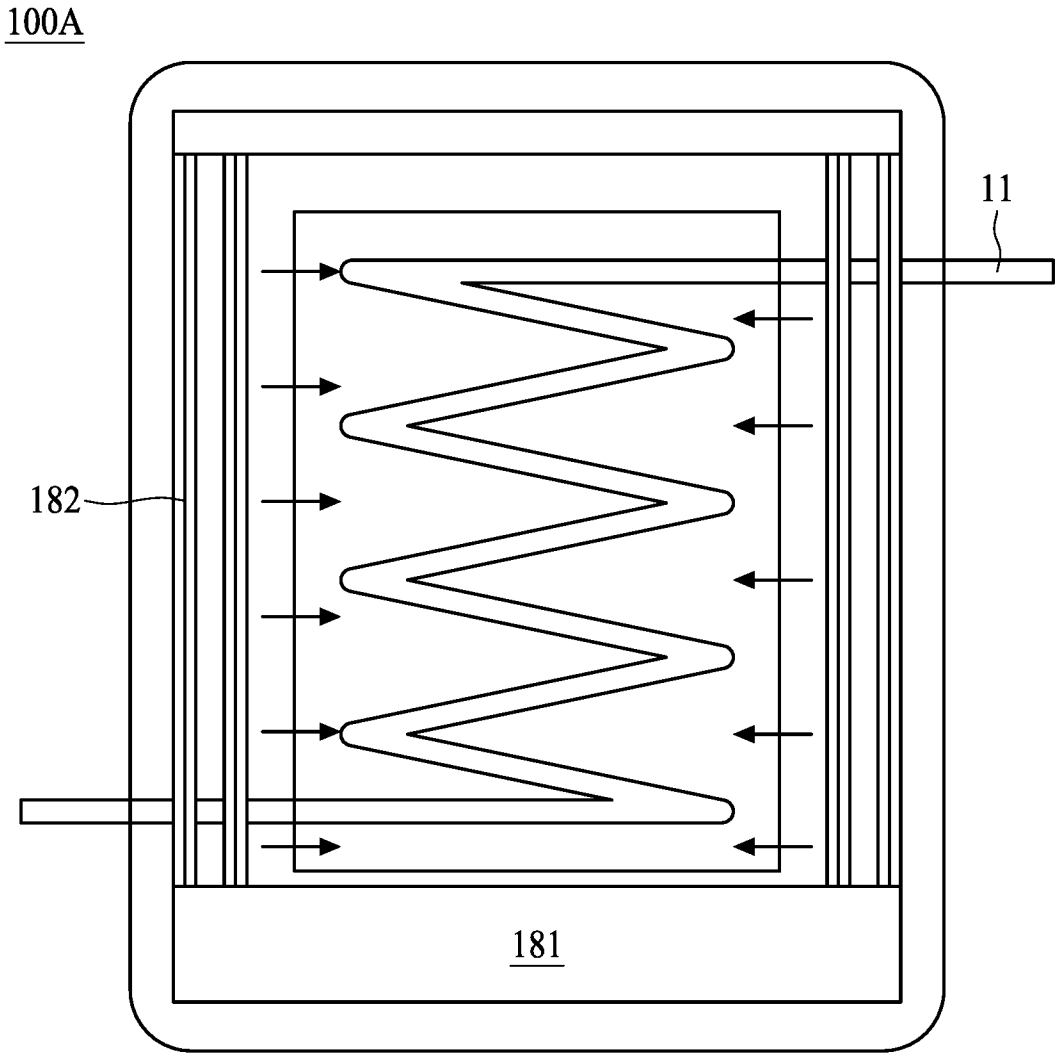
FIG. 3A is a cross sectional view showing a radiative heating unit including an infrared light source, in accordance with some embodiments of the present disclosure.

Referring to FIG. 2 and FIG. 3A, FIG. 3A is a cross sectional view showing a radiative heating unit including an infrared light source, in accordance with some embodiments of the present disclosure. In some embodiments, the first radiative heating unit 100 may be an infrared heater 100A. The infrared heater 100A includes a temperature controller 181 and an infrared light source 182. A temperature control unit 210 of the wet chemical heating system 2000*a* is communicatively coupled to the temperature controller 181 of the infrared heater 100A, thence the temperature control unit 210 can control the heat flux of the infrared light source 182 through the temperature controller 181. Since medium or contact is not necessary for radiation, the infrared light source 182 can remotely heat the wet chemical 219 without directly contacting the first conduit 11. In some embodiments, the first conduit 11 is configured to loop within the infrared heater 100A, so that a total time period of heating is increased while avoiding significant increase of accommodating space.

Figure 3B:
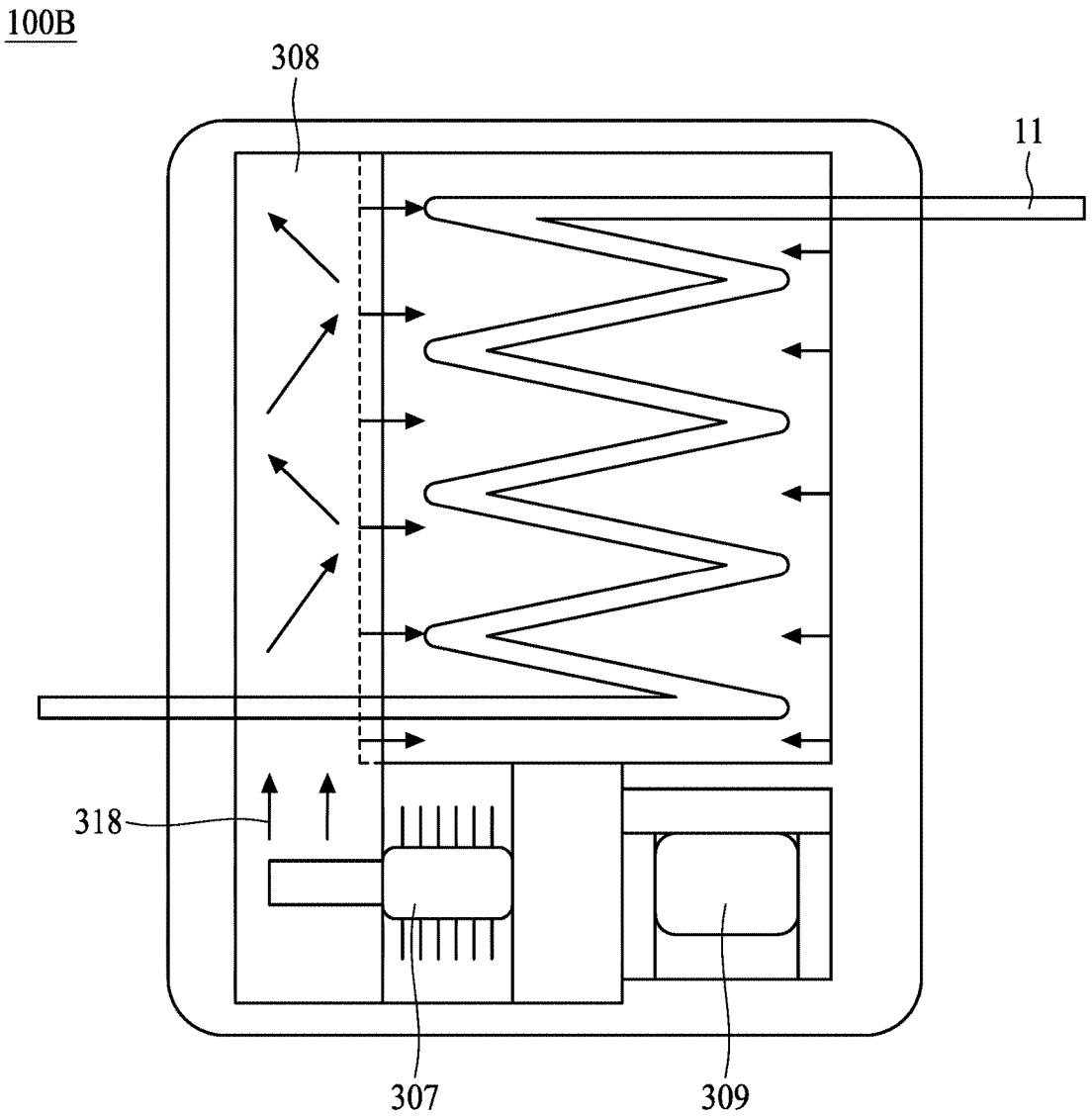
FIG. 3B is a cross sectional view showing a radiative heating unit including a microwave source, in accordance with some embodiments of the present disclosure.

Referring to FIG. 2 and FIG. 3B, FIG. 3B is a cross sectional view showing a radiative heating unit including a microwave source, in accordance with some embodiments of the present disclosure. In some embodiments, the first radiative heating unit 100 may be a microwave heater 100B. The microwave heater 100B may include a transformer 309, a magnetron 307, and a waveguide 308. The transformer 309 can alter a voltage of a power supplied by the temperature control unit 210 of the wet chemical heating system 2000*a*, the magnetron 307 then generate and emit microwave 318. The waveguide 308 can convey microwave 318 along a predetermined direction, thus the objects in the space within the microwave heater 100B can be heated by microwave 318. Microwave 318 is an electromagnetic radiation which can induce rotation or oscillation of polar molecules, therefore microwave 318 may elevate the temperature of wet chemical 219.

Conventionally, when a non-radiative heater is configured to heat the wet chemical by $T_1$° C. above ambient temperature by directly contacting the first conduit, the first conduit may be heated more than $T_1$° C. above ambient temperature to allow the wet chemical reach the target temperature due to the fact that the first conduit may include lower thermal conductivity materials such as plastic or polymer. Under such condition, the first conduit under higher temperature may induce reliability issues thereto, such as deformation, oxidation, peeling, or generating defects; while the efficient of heating is restricted since the heater has to provide extra energy in order to heat the wet chemical by $T_1$° C. above ambient temperature. The performance with regard to heating the wet chemical is limited under conventional setting.

In the present disclosure, microwave 318 can remotely heat the wet chemical 219 without significantly elevating the temperature of the first conduit 11. Specifically, the absorption of microwave for wet chemical 219 is greater than the absorption of microwave for the first conduit 11; therefore the efficiency for heating the wet chemical 219 is improved as limitation of heating is lessen. In some embodiments, the first conduit 11 is free from absorbing microwave 318. For example, if the wet chemical 219 is heated by $T_2$° C. above ambient temperature, the first conduit 11 may be elevated by less than $T_2$° C. above ambient temperature. Therefore the wet chemical 219 can be heated to a higher temperature since the first conduit 11 may have a relatively lower temperature comparing to the wet chemical 219. The temperature of the first conduit 11 can stay below a predetermined threshold temperature of inducing reliability issues such as deformation, oxidation, peeling, or generating defects. In some embodiments, the first conduit 11 is configured to loop within the microwave heater 100B, so that a total time period of heating is increased while avoiding significant increase of accommodating space.

It is noteworthy that the first radiative heating unit 100 can be an infrared heater 100A or a microwave heater 100B, or can be substituted by any radiation generator which can be used as a heater to heat the wet chemical 219. In addition, in some embodiments, the first radiative heating unit 100 is disposed proximal to the first dispensing head 21 so as to minimize the loss of thermal energy. In some embodiments, the first radiative heating unit 100 can be disposed under the CMP platen 1.

Referring to FIG. 2, FIG. 3A, and FIG. 3B, the wet chemical heating system 2000*a* may optionally include a first temperature sensor 219C for detecting a temperature of the wet chemical 219 that comes out from the first dispensing head 219. In some embodiments, the first temperature sensor 219C detects a temperature of the wet chemical 219 exiting the first dispensing head 21. In some embodiments, the first temperature sensor 219C is disposed around or at the nozzle of the first dispensing head 21 to detect a temperature of the wet chemical 219 prior to being applied on the CMP platen 1. In some other embodiments, the first temperature sensor 219C is configured to detect a temperature of the wet chemical 219 as-dispensed on the CMP platen 1. The first temperature sensor 219C may be a thermocouple, a thermometer, an infrared thermometer, or other suitable device for detecting a temperature of a liquid material. The first temperature sensor 219C may be communicatively coupled to the temperature control unit 210 of the wet chemical heating system 2000*a*, wherein the first temperature sensor 219C can transmit the detected temperature of the wet chemical 219 to the temperature control unit 210, so the temperature control unit 210 can adjust the heat flux or the magnitude of radiation generated by the first radiative heating unit 100. For example, if a detected temperature of the wet chemical 219 is lower than a predetermined value, the temperature control unit 210 of the wet chemical heating system 2000*a* may adjust the infrared light source 182 of the infrared heater 100A to emit infrared with greater energy flux or adjust the microwave heater 100B to generate microwave 318 with greater energy flux. On the other hand, if a detected temperature of the wet chemical 219 is greater than a predetermined value, the temperature control unit 210 may adjust the infrared light source 182 of the infrared heater 100A to emit infrared with lower energy flux or adjust the microwave heater 100B to generate microwave 318 with lower energy flux. In some embodiments, the first temperature sensor 219C can provide real time detection as the temperature control unit 210 can provide immediate adjustment to precisely control the temperature of the wet chemical 219.

Figure 4:
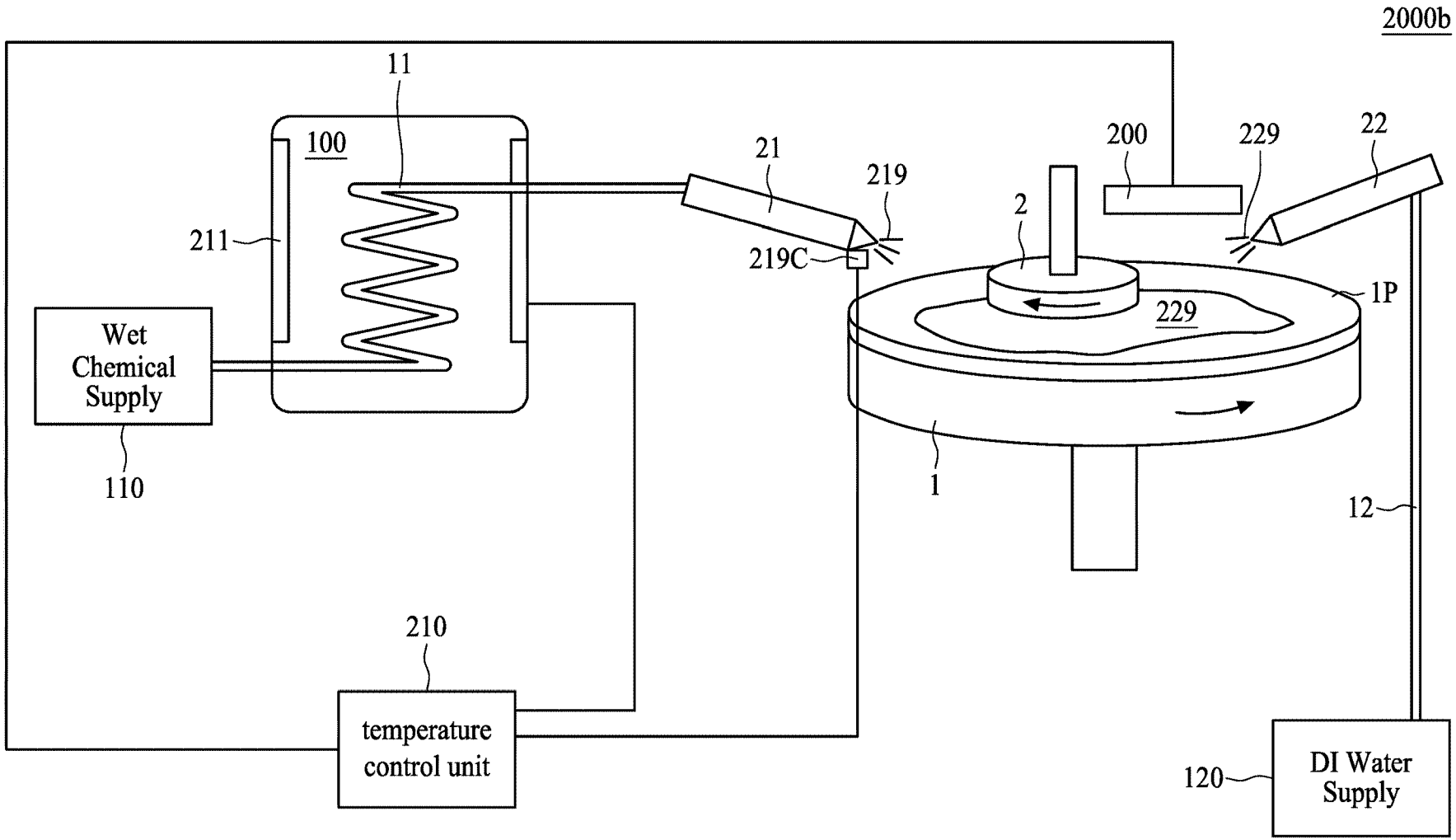
FIG. 4 is a schematic view showing a wet chemical heating system, in accordance with some embodiments of the present disclosure.

Referring to FIG. 4, FIG. 4 is a schematic view showing a wet chemical heating system 2000*b*, in accordance with some embodiments of the present disclosure. Note that hereinafter elements in FIG. 4 being the same as or similar to aforesaid counterparts in FIG. 2 are denoted by the same reference numerals, as duplicated explanations are omitted. The wet chemical heating system 2000*b* may further include a second radiative heating element 200. The second radiative heating element 200 is configured to heat the CMP platen 1 (or at least heating the pad 1P disposed at the top surface of the CMP platen 1), so that a top surface of the CMP platen 1 can sustain at a predetermined elevated temperature. An advantage of having the second radiative heating element 200 over the platen 1 is that temperature of the wet chemical 219 may not significantly decrease subsequent to contacting the CMP platen 1. In some embodiments, a top surface of the CMP platen 1 (which may also be a top surface of the pad 1P) may be elevated by at least 3° C. so that the wet chemical 219 can be effectively heated when dispensing on the CMP platen 1. In some embodiments, the top surface of the CMP platen 1 (which may also be a top surface of the pad 1P) may be elevated up to 75° C. before material property of the wet chemical 219 being significantly altered. In some embodiments, elevating the top surface of the CMP platen 1 to more than 75° C. may alter mechanical property of pad 1P and/or colloidal stability of the wet chemical 219 on the CMP platen 1, in which desired CMP operation result may not be obtained.

In some embodiments, the second radiative heating element 200 may include an infrared light source. Since medium or contact is not necessary for radiation, the infrared light source of the second radiative heating element 200 can remotely heat the CMP platen 1 without directly contacting the CMP platen 1. As such, the CMP platen 1 can be heated without contacting with the second radiative heating element 200. For example, the second radiative heating element 200 can be disposed at least 10 cm above the CMP platen 1, but the present disclosure is not limited thereto. The heating element 200 may be communicatively coupled to the temperature control unit 210 of the wet chemical heating system 2000*b*, so the temperature control unit 210 can control the heat flux of the infrared light source of the heating element 200.

In some embodiments, the second radiative heating element 200 may include a microwave source. Deionized water 229 (DI water) is applied on the CMP platen 1 prior to dispensing the wet chemical 219 on the CMP platen 1. Since the absorption of microwave for liquid material is greater than the absorption of microwave for solid material, DI water can be heated by the microwave source and effectively elevate the temperature of the CMP platen 1. In some embodiments, the first conduit 11 is free from absorbing microwave 318. Herein DI water 229 is supplied by a DI water supply 120, and DI water 229 is transported by a second conduit 12 to a second dispensing head 22 above the CMP platen 1. The second dispensing head 22 is configured to dispense DI water on the CMP platen 1. The DI water supply 120 may include a storage space for accommodating DI water 229 and a pump for supplying DI water 229. It should be noted that DI water 229 may optionally include cleaning chemicals for cleaning the CMP platen 1 prior to a CMP operation or subsequent to a CMP operation, as DI water 229 can be substituted by ultrapure water or other liquid suitable for cleaning the CMP platen 1 or for serving as a solvent of a cleaning agent. Optionally, prior to dispensing the wet chemical 219 on the CMP platen 1, DI water 229 is removed from the CMP platen 1, or the flowing of DI water 229 is stopped, to obviate undesired dilution of the wet chemical 219 in some embodiments, which may deteriorate the performance of CMP operation for some cleaning or polishing process; or alternatively in some other embodiments, DI water 229 can be applied to perform on-platen chemical dilution when needed.

In some embodiments, a platen temperature sensor (not shown in FIG. 4) is disposed on, in or around the CMP platen 1 to detect a temperature of the CMP platen 1, and the platen temperature sensor can transmit the temperature of the CMP platen 1 to the temperature control unit 210 for further adjustment of the power output of the heating element 200.

Figure 5:
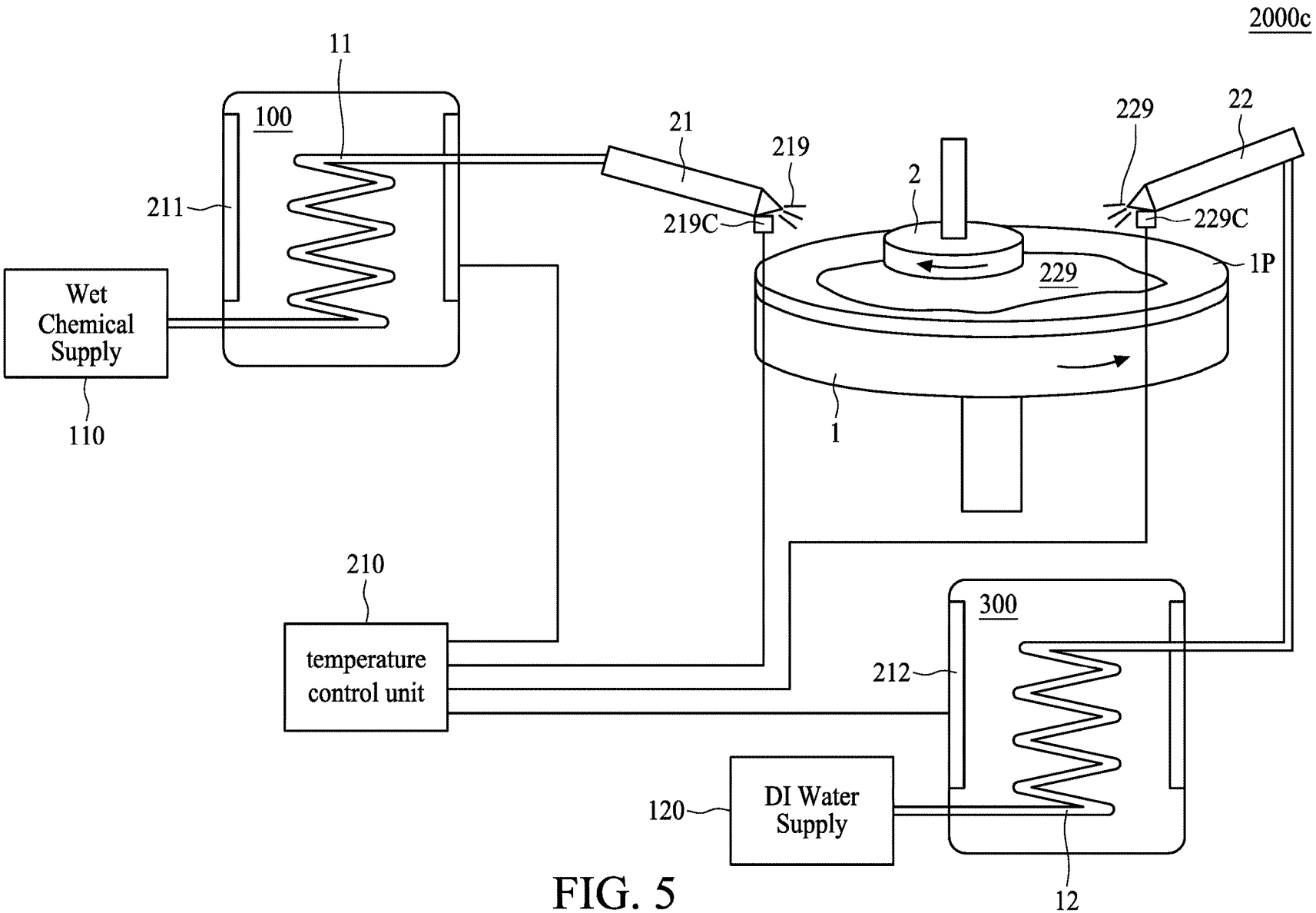
FIG. 5 is a schematic view showing a wet chemical heating system, in accordance with some embodiments of the present disclosure.

Referring to FIG. 5, FIG. 5 is a schematic view showing a wet chemical heating system 2000*c*, in accordance with some embodiments of the present disclosure. Note that hereinafter elements in FIG. 5 being the same as or similar to aforesaid counterparts in FIG. 2 to FIG. 4 are denoted by the same reference numerals, as duplicated explanations are omitted. In some embodiments, the CMP platen 1 may be heated by DI water with an elevated temperature, as DI water is heated prior to being dispensed on the CMP platen 1. Specifically, DI water 229 is supplied by the DI water supply 120, and transported by the second conduit 12 to the second dispensing head 22 configured to dispense DI water 229 on the CMP platen 1. A second radiative heating unit 300 having a third radiative heating element 212 is configured to heat DI water 229 in the second conduit 12. The second radiative heating unit 300 is positioned at an upper stream of the second dispensing head 22, so that DI water is preheated before being dispensed on the CMP platen 1. In order to effectively elevate a temperature of the CMP platen 1, DI water 229 is heated at least by 3° C. at the exit compared to at the entrance of the second dispensing head 22. In some embodiments, DI water 229 may be elevated up to 95° C. before boiling point of water is reached.

Since a material of the second conduit 12 may be similar to the first conduit 11, DI water 229 is remotely heated by the third second radiative heating element 212. In some embodiments, the second radiative heating unit 300 can be an infrared heater 100A previously discussed in FIG. 3A. The third radiative heating element 212 can be an infrared light source communicatively connected to the temperature control unit 210 so that the heat flux of the infrared light source can be instantly controlled. In some embodiments, the second radiative heating unit 300 can be a microwave heater 100B previously discussed in FIG. 3B. Microwave is generated to elevate a temperature of DI water 229 in the second conduit 12, and the third radiative heating element 212 is communicatively connected to the temperature control unit 210 so the energy flux of microwave can be controlled instantly. Specifically, the absorption of microwave for DI water 229 is greater than the absorption of microwave for the second conduit 12; therefore the efficiency for heating DI water 229 is improved as limitation of heating is lessen. In some embodiments, the second conduit 12 is configured to loop within the second radiative heating unit 300, so that a total time period of heating is increased while avoiding significant increase of accommodating space.

It is noteworthy that the second radiative heating unit 300 can be an infrared heater 100A or a microwave heater 100B, or can be substituted by any radiation generator which can be used as a heater to heat DI water 229. In addition, in some embodiments, the second radiative heating unit 300 is disposed proximal to the second dispensing head 22 so as to minimize the loss of thermal energy.

Optionally, prior to dispensing the wet chemical 219 on the CMP platen 1, DI water 229 is removed from the CMP platen 1, or the flowing of DI water 229 is stopped, to obviate undesired dilution of the wet chemical 219 in some embodiments, which may deteriorate the performance of CMP operation for some cleaning or polishing process; or alternatively in some other embodiments, DI water 229 can be applied to perform on-platen chemical dilution when needed.

In some embodiments, the wet chemical heating system 2000*c* may optionally include a second temperature sensor 229C for detecting a temperature of DI water 229. In some embodiments, the second temperature sensor 229C detects a temperature of DI water 229 in the second dispensing head 22. In some embodiments, the second temperature sensor 229C is disposed around or at the nozzle of the second dispensing head 22 to detect a temperature of DI water 229 prior to being applied on the CMP platen 1. In some other embodiments, the second temperature sensor 229C is configured to detect a temperature of DI water 229 as-dispensed on the CMP platen 1. The second temperature sensor 229C may be a thermocouple, a thermometer, an infrared thermometer, or other suitable device for detecting a temperature of a liquid material.

The second temperature sensor 229C may be communicatively coupled to the temperature control unit 210 of the wet chemical heating system 2000*c*. The second temperature sensor 229C can transmit the detected temperature of DI water 229 to the temperature control unit 210, so the temperature control unit 210 can adjust the heat flux or the magnitude of radiation generated by the second radiative heating unit 200. For example, if a detected temperature of DI water 229 is lower than a predetermined value, the temperature control unit 210 of the wet chemical heating system 2000*c* may adjust the infrared light source of the infrared heater 100A to emit infrared with greater energy flux or adjust the microwave heater 100B to generate microwave 318 with greater energy flux. On the other hand, if a detected temperature of DI water 229 is greater than a predetermined value, the temperature control unit 210 may adjust the infrared light source 182 of the infrared heater 100A to emit infrared with lower energy flux or adjust the microwave heater 100B to generate microwave 318 with lower energy flux. In some embodiments, the second temperature sensor 229C can provide real time detection as the temperature control unit 210 can provide immediate adjustment to precisely control the temperature of DI water 229.

In some other embodiments, the wet chemical 219 in the first conduit 11 and DI water 229 in the second conduit 12 are both heated by the first radiative heating unit 100 under the consideration of saving space. Alternatively stated, the first radiative heating unit 100 and the second radiative heating unit 300 as depicted in FIG. 5 can be merged to be a single radiative heating unit heating the wet chemical 219 in the first conduit 11 and DI water 229 in the second conduit 12.

Figure 6:
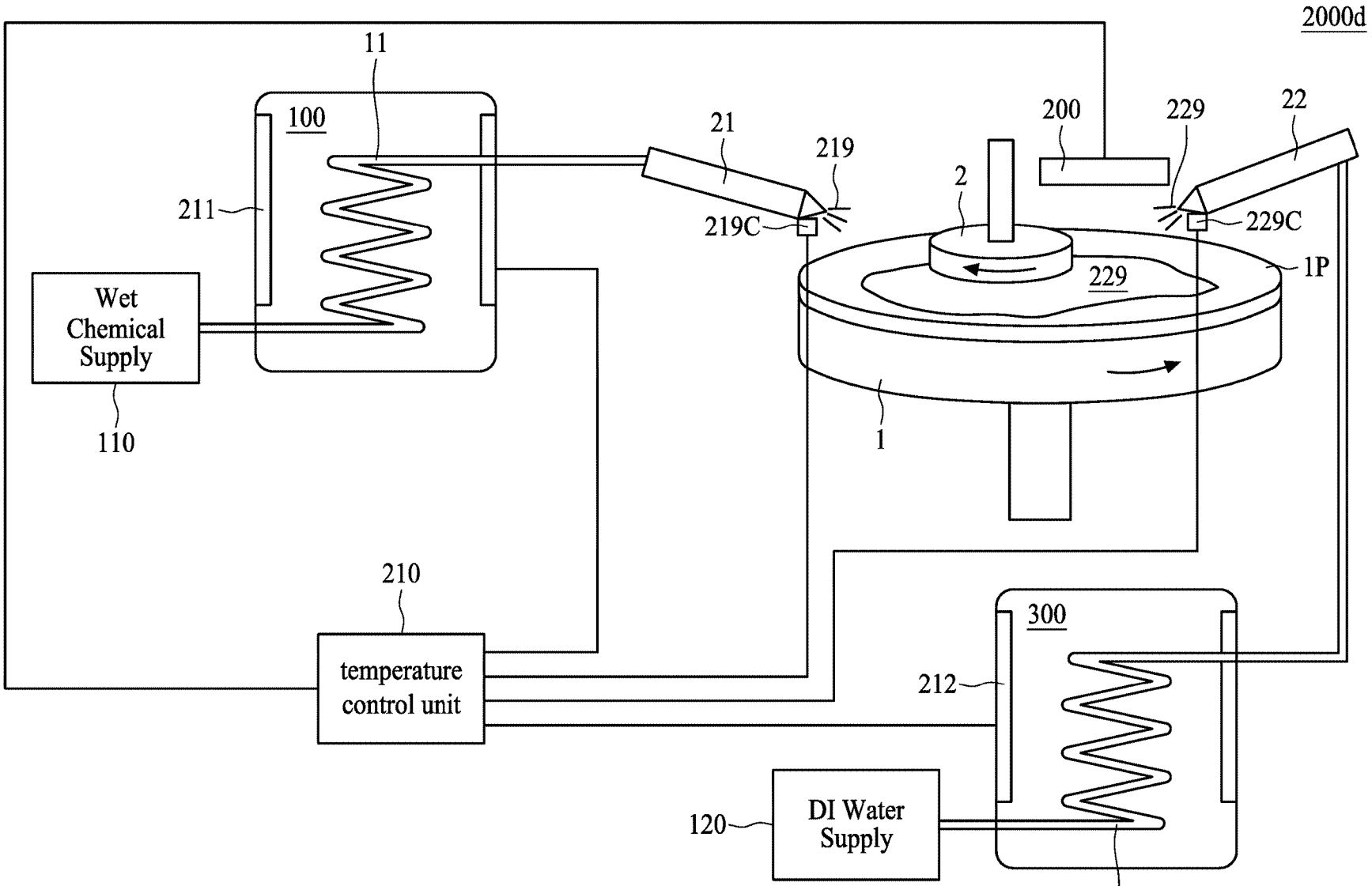
FIG. 6 is a schematic view showing a wet chemical heating system, in accordance with some embodiments of the present disclosure.

Referring to FIG. 6, FIG. 6 is a schematic view showing a wet chemical heating system 2000*d*, in accordance with some embodiments of the present disclosure. Note that hereinafter elements in FIG. 6 being the same as or similar to aforesaid counterparts in FIG. 2 to FIG. 5 are denoted by the same reference numerals, as duplicated explanations are omitted. In some embodiments, the wet chemical heating system 2000*d* includes the first radiative heating unit 100, the second radiative heating element 200, and the second radiative heating unit 300, as set forth in FIG. 2 to FIG. 5.

Throughput rate of CMP operation is positively correlated to a temperature of CMP slurry, so the CMP slurry can be heated to improve the performance of CMP operation. The present disclosure provides wet chemical heating systems including radiative heating element to heat wet chemical entailed in CMP operation without contacting a conduit for transporting the wet chemical to avoid the induction of reliability issues, such as deformation, oxidation, peeling, or generating defects, thence deteriorating the yield rate of fabricated semiconductor structure.

The first radiative heating unit 100 can heat the wet chemical 219 without directly contacting the first conduit 11, which may be composed of plastic or polymer (e.g. fluoropolymers). Thereby the wet chemical 219 can be heated prior to dispensing in order to improve the performance of CMP operation. The second radiative heating unit 300 can heat DI water 229 without directly contacting the second conduit 12, which may be composed of plastic or polymer (e.g. fluoropolymers), and DI water 229 may be applied on the CMP platen 1 to heat the CMP platen, which can avoid significant decrease of a temperature of the subsequently dispensed wet chemical 219. Similarly DI water 229 is heated without the second conduit 12 being contacted by the second radiative heating unit 300. In addition, a second radiative heating element 200 can be utilized to heat the CMP platen 1 to avoid significant decrease of a temperature of the wet chemical 219 dispensed on the CMP platen 1. The first radiative heating unit 100 and the second radiative heating unit 300 may utilize infrared light or microwave to heat the wet chemical 219 or DI water 229 in the conduit, thus the conduit may not be contacted by the aforesaid heating units or heating elements. The second radiative heating element 200 may be included to heat the CMP platen 1, which can also utilize infrared light or microwave.

The temperature control unit 210 discussed in the present disclosure can be implemented by software such that the foregoing methods disclosed therein can be fully-automatically or semi-automatically performed. For a given computer, the software routines can be stored on a storage device, such as a permanent memory. Alternately, the software routines can be machine executable instructions stored using any machine readable storage medium, such as a diskette, CD-ROM, magnetic tape, digital video or versatile disk (DVD), laser disk, ROM, flash memory, etc. The series of instructions could be received from a remote storage device, such as a server on a network. The present invention can also be implemented in hardware systems, microcontroller unit (MCU) modules, discrete hardware or firmware.

Some embodiments of the present disclosure provide a wet chemical heating system, including a first conduit for transporting wet chemical, a dispensing head connected to the first conduit, and a radiative heating element configured to heat the wet chemical in the first conduit and positioned at an upper stream of the dispensing head.

Some embodiments of the present disclosure provide a heating device for heating chemical mechanical polishing (CMP) slurry, including a CMP platen, a slurry conduit, configured to transport a CMP slurry and dispense the CMP slurry on the CMP platen, and a first radiative heating element configured to heat the CMP slurry.

Some embodiments of the present disclosure provide a method of chemical mechanical polishing (CMP), including providing a CMP slurry in a slurry conduit, heating the CMP slurry by a first radiative heating unit, and dispensing the CMP slurry on a CMP platen.

The foregoing outlines features of several embodiments so that those skilled in the art may better understand the aspects of the present disclosure. Those skilled in the art should appreciate that they may readily use the present disclosure as a basis for designing or modifying other operations and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A wet chemical heating system, comprising:

a first conduit for transporting wet chemical, wherein the first conduit is made of a flexible material;

a dispensing head connected to the first conduit; and a radiative heating element configured to heat the wet chemical at a first portion of the first conduit to a first temperature greater than a second temperature of the first portion of the first conduit, and the radiative heating element is positioned at an upper stream of the dispensing head.

2. The wet chemical heating system of claim 1, wherein the radiative heating element comprises a microwave source.

3. The wet chemical heating system of claim 1, wherein the radiative heating element comprises an infrared light source.

4. The wet chemical heating system of claim 1, further comprising a temperature control unit communicatively coupling with the radiative heating element.

5. The wet chemical heating system of claim 1, further comprising a second conduit transporting DI water.

6. The wet chemical heating system of claim 1, wherein the flexible material comprises fluoropolymers.

7. A heating device for heating chemical mechanical polishing (CMP) slurry, comprising:

a CMP platen;

a slurry conduit, configured to transport a CMP slurry and dispense the CMP slurry on the CMP platen, wherein the slurry conduit is made of a flexible material; and a first radiative heating element configured to heat the CMP slurry at a first portion of the slurry conduit to a first temperature, wherein the first temperature is greater than a second temperature of the first portion of the slurry conduit.

8. The heating device for heating CMP slurry of claim 7, wherein the first radiative heating element is positioned at an upper stream of the slurry conduit to heat the CMP slurry in the slurry conduit.

9. The heating device for heating CMP slurry of claim 7, further comprising a second radiative heating element, configured to heat the CMP platen to a temperature less than or equal to 75 degree Celsius.

10. The heating device for heating CMP slurry of claim 9, wherein the first radiative heating element comprises a microwave source and the second radiative heating element comprises an infrared light source.

11. The heating device for heating CMP slurry of claim 7, wherein the first radiative heating element comprises an infrared light source.

12. The heating device for heating CMP slurry of claim 7, further comprising a DI water conduit, configured to transport DI water and dispense DI water on the CMP platen.

13. The heating device for heating CMP slurry of claim 12, wherein the DI water in the DI water conduit is heated by a third radiative heating element.

14. The heating device for heating CMP slurry of claim 7, further comprising a temperature control unit configured to detect a temperature of the CMP slurry and communicatively coupling with the first radiative heating element.

15. A method of chemical mechanical polishing (CMP), comprising:

providing a CMP slurry in a slurry conduit;

heating the CMP slurry by a first radiative heating unit at a first portion of the slurry conduit, comprising:

elevating a temperature of the CMP slurry at the first portion of the slurry conduit to a first temperature greater than an ambient temperature, wherein a second temperature of the first portion of the slurry conduit is less than the first temperature; and dispensing the CMP slurry on a CMP platen.

16. The method of claim 15, wherein the CMP slurry is dispensed on a CMP platen subsequent to applying the radiation to the CMP slurry in the slurry conduit.

17. The method of claim 15, further comprising dispensing DI water on a CMP platen prior to dispensing the CMP slurry.

18. The method of claim 17, further comprising heating DI water by a second radiative heating unit prior to dispensing DI water on the CMP platen, the second radiative heating unit being different from the first radiative heating unit.

19. The method of claim 15, wherein the slurry conduit is free from absorbing a radiation from the first radiative heating unit.

20. The method of claim 15, further comprising:

sensing a temperature of the CMP slurry; and adjusting a power of the radiative heating unit according to the temperature of the CMP slurry.

* * * * *